US007083306B2

(12) United States Patent
Van Gennip et al.

(10) Patent No.: US 7,083,306 B2
(45) Date of Patent: Aug. 1, 2006

(54) DISCHARGE LAMP WITH A REFLECTOR AND AN ASYMMETRICAL BURNER

(75) Inventors: Nicasius G. T. Van Gennip, Heeze (NL); Michael Haacke, Aachen (DE); Thomas Luce, Esslingen (DE); Petrus J. M. Fransen, Nederweert (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 36 days.

(21) Appl. No.: 10/500,505

(22) PCT Filed: Dec. 12, 2002

(86) PCT No.: PCT/IB02/05297

§ 371 (c)(1),
(2), (4) Date: Jun. 29, 2004

(87) PCT Pub. No.: WO03/056235

PCT Pub. Date: Jul. 10, 2003

(65) Prior Publication Data

US 2005/0036330 A1 Feb. 17, 2005

(30) Foreign Application Priority Data

Jan. 2, 2002 (DE) ..... 102 00 010

(51) Int. Cl.
*F21V 7/00* (2006.01)

(52) U.S. Cl. ..... 362/296; 362/217; 362/341

(58) Field of Classification Search ..... 362/217, 362/221, 263, 265, 296, 341, 551; 313/113
See application file for complete search history.

(56) References Cited

U.S. PATENT DOCUMENTS

| | | | | |
|---|---|---|---|---|
| 3,684,908 | A * | 8/1972 | Beese | 313/24 |
| 5,138,219 | A * | 8/1992 | Krisl et al. | 313/112 |
| 6,049,169 | A * | 4/2000 | Gibson et al. | 313/635 |
| 6,246,170 | B1 * | 6/2001 | Sugawara | 313/570 |
| 6,710,521 | B1 * | 3/2004 | Tsuda et al. | 313/113 |
| 6,784,601 | B1 * | 8/2004 | Kai et al. | 313/46 |

* cited by examiner

*Primary Examiner*—Thomas M. Sember
*Assistant Examiner*—Adam C. Rehm

(57) ABSTRACT

The invention relates to a discharge lamp with a reflector (1) and an asymmetrical burner, which reflector (1) comprises at least a reflecting surface (3) and a hollow reflector neck (4), while the asymmetrical burner is partly arranged in said hollow reflector neck (4) without making contact therewith, wherein the shape and the size of the inner contour (6) of the reflecting surface (3) of the reflector (1) corresponds substantially to the contour of the asymmetrical burner, and the asymmetrical burner is centrally located in the reflector (1).

4 Claims, 1 Drawing Sheet

DISCHARGE LAMP WITH A REFLECTOR AND AN ASYMMETRICAL BURNER

Figure 1:
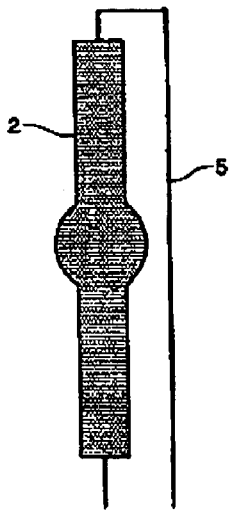

The invention relates to a discharge lamp with a reflector and an asymmetrical burner, which reflector comprises at least a reflecting surface and a hollow reflector neck, while the burner is partly arranged in said hollow reflector neck without making contact therewith.

The light quality is dependent on various parameters, for example the efficiency of the reflector, in the case of a discharge lamp comprising at least a burner and a reflector. The efficiency of the reflector is influenced not only by the nature and quality of its reflecting surface, but also by the reflector geometry. The reflector geometry attuned to the respective application, i.e. in particular its shape and size, is inextricably interlinked with the nature of the light source and the geometry thereof.

A light source in the sense of the invention may be, for example, a known burner of a discharge lamp with a return pole. Such a burner with a return pole, which may be used, for example, in headlights of motor vehicles, has an asymmetrical shape on account of its construction. If such conventional discharge lamps are used, for example, for applications in which light is emitted with as low a loss as possible and is focused on a point or on a defined region, the efficiency of the reflector is dependent inter alia on the size of the reflecting surface area. The inner contours of the reflecting surfaces of the relevant known reflectors, which have a hollow reflector neck, all have a circular shape. The use of such a shape of the inner contour and of an asymmetrical burner renders it impossible to avoid an impairment of the light quality, here in particular of the light output. If the efficiency of the reflector has a particular significance, for example in applications where the light reflected by the reflector is coupled into an optical waveguide, a significant impairment of the light quality can be observed, caused by regularly occurring coupling losses. Losses again occur in the emission of the light from the optical waveguide each time, independently of the former losses, so that the efficiency of the reflector in such an optical waveguide system is one of the substantial determining factors for the total efficiency of the system. The use of such an optical waveguide system as a lighting system for motor vehicles, where standardized values must be achieved on a regular basis with respect to the light quality, necessitates a very exact and expensive attunement of the optical system components. Optical waveguide systems for motor vehicles which have at least one light source, comprising at least one discharge lamp with a reflector and an asymmetrical burner, are in the focus of development. These optical waveguide systems comprise inter alia a system of optical waveguide cables and optical elements which realize and support the coupling of the light into and from the optical waveguide, thus making the light available for the desired application, for example through a headlight of a motor vehicle, in a known manner.

It is an object of the invention to provide a discharge lamp which can be manufactured in a technologically simple and inexpensive manner, while a required light quality is safeguarded by a good efficiency of the reflector.

The object is achieved in that the shape and the size of the inner contour of the reflecting surface of the reflector corresponds substantially to the contour of the burner, and in that the burner is centrally located in the reflector.

The invention renders it possible to realize an optimized adaptation of the shape and size of the inner contour of the reflecting surface of the reflector to the contour of the burner, in particular taking into account the tolerances necessary for mounting and adjustment of the asymmetrical burner and the reflector, the inner contour of the reflecting surface of the reflector, which merges directly into the reflector neck, being greater than the outer contour of the burner. This adaptation according to the invention offers the largest possible reflecting surface area of the reflector, an adaptation whose significance for the total efficiency of the reflector lamp, in particular in special applications, was ascertained by a plurality of laboratory experiments and which those skilled in the art have never before conceived or realized. Surprisingly simple means according to the invention thus provide a reflector lamp which can be used as an effective light source for optical waveguide systems. The central arrangement of the burner in the reflector in particular safeguards a simple and accurate adjustment of the focus.

Discharge lamps in the sense of the invention are all known lamp types with an asymmetrically shaped burner and a reflector. The asymmetrically shaped burners are in particular burners of discharge lamps known per se with return poles.

The reflector according to the invention then comprises usual materials such as glass, ceramic material, metal, and/or synthetic resin.

The expression "contour of the burner" is to be understood as being the outermost contour of the burner within the scope of the invention, i.e. the contour visible in the plan view (x-y plane) of the discharge lamp comprising an asymmetrical burner in the incorporated state, for example as shown in FIG. 1.

In a preferred embodiment of the solution according to the invention, the inner contour of the reflecting surface of the reflector is symmetrical with respect to the x-axis and asymmetrical with respect to the y-axis, while the asymmetrical portion of the burner extends in the direction of the x-axis after being assembled. Such a shaping of the inner contour of the reflecting surface of the reflector as proposed here renders it possible to use simple geometric shapes, such as semi-circular arcs and straight lines, while fulfilling the criteria mentioned above, resulting in a satisfactory adaptation of the respective inner contour to the outer contour of the burner in many applications, while observing the necessary tolerances.

A further preferred embodiment of the invention in this respect is characterized in that the inner contour of the reflecting surface of the reflector has the shape of an ellipse or of a rectangle with rounded corners.

An alternative embodiment of the invention is characterized in that the inner contour of the reflecting surface of the reflector is adapted to the contour of the burner such that the surface area of the reflecting surface reaches a maximum. Such a maximum is reached when very high requirements are imposed on the mutual agreement of the contours, while observing the necessary tolerances. This embodiment is technologically more complicated and accordingly requires a correspondingly higher expenditure in industrial mass manufacture.

The object of the invention is furthermore achieved in that a discharge lamp as claimed in the claims 1 to 4 is used as a light source in an optical waveguide system which serves as a lighting system for a motor vehicle and which has at least one light source comprising a discharge lamp with a reflector and an asymmetrical burner.

Optical waveguide systems within the scope of the invention comprise besides a light source at least a system of optical waveguide cables and optical elements which couple the light into and from the optical waveguide and which realize and support the provision of the light to the envisaged application, for example for lighting purposes, in a known manner.

Figure 2:
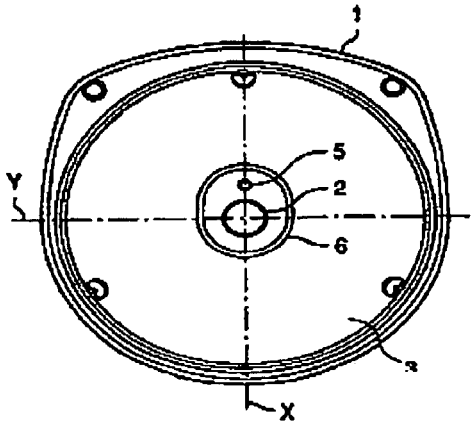
Figure 3:
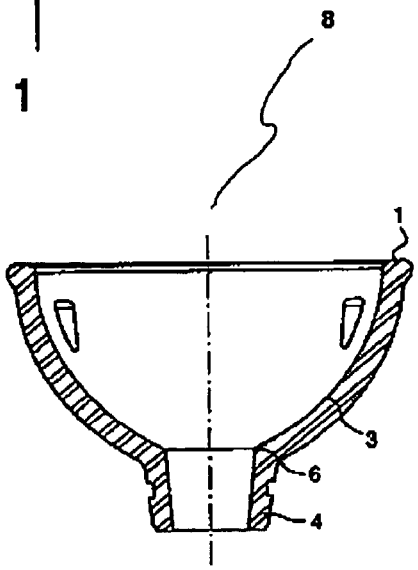

The invention will be explained in more detail below with reference to an embodiment. In the Figure:

FIG. 1 diagrammatically shows a burner with a return pole of a discharge lamp, FIG. 2 shows a discharge lamp with a return pole in plan view, and FIG. 3 shows the reflector of the discharge lamp in lateral sectional view.

FIG. 1 diagrammatically shows a burner 2 with return pole 5 of a discharge lamp, which burner 2 is connected to the return pole 5 with electrical conduction in a known manner.

FIG. 2 is a plan view of a discharge lamp with a return pole 5 (for example a xenon lamp) for an optical waveguide system for the headlight of a motor vehicle. The reflector 1 is made of a borosilicate glass here and has a reflecting surface 3 and a hollow reflector neck 4. The burner 2 is centrally located in the reflector 1 by means of a retention device (not shown in FIG. 1) at least partly in the hollow reflector neck 4, without contact between the inner surface of the reflector neck 4 and the outer surface of the burner 2. A retention device fixes the burner 2 in a defined position which safeguards an optimum luminous intensity and focusing of the reflected light on the focus lying outside the reflector 1. In this focus, the reflected light is fed into an optical waveguide cable which is known per se, for example a glass fiber cable, of an optical waveguide system in a usual manner. The inner contour 6 of the reflecting surface 3 of the reflector 1 is symmetrical with respect to the x-axis in the x-y plane, and asymmetrical with respect to the y-axis. The inner contour 6 of the reflecting surface 3 of the reflector 1 is formed by simple geometric shapes, i.e. by two semi-circular arcs of equal size which are interconnected by two parallel straight lines. Given a radius of the semi-circular arcs of approximately five millimeters each, the distance of the inner contour 6 from the point of intersection of the x- and y-axes on the x-axis is approximately five millimeters and seven millimeters, respectively.

FIG. 3 shows the reflector of FIG. 2 in a cross-sectional lateral view. A reflector axis 8 extends through the center of the burner 2 in a direction orthogonal to the x-y plane shown in the plan view of FIG. 2.

The invention claimed is:

1. A discharge lamp with a reflector (1) and an asymmetrical burner, which reflector (1) comprises at least a reflecting surface (3) and a hollow reflector neck (4), while the asymmetrical burner is partly arranged in said hollow reflector neck (4) without making contact therewith, characterized in that the shape and the size of the inner contour (6) of the reflecting surface (3) of the reflector (1) has a substantially oval asymmetrical shape corresponding substantially to the contour of the asymmetrical burner and return pole, wherein the shape and size of an inner contour (6) of the reflecting surface is symmetrical in an x-direction and asymmetrical in a y-direction in a cross-sectional view of said hollow reflector neck (4) and orthogonal to the reflector axis (8), and in that the asymmetrical burner is centrally located in the reflector (1), the asymmetry in the y-direction for preventing rotation of the asymmetrical burner in said hollow reflector neck and for increasing a reflective surface area of said hollow reflector neck thereby increasing the light output efficiency.

2. A discharge lamp as claimed in claim 1, characterized in that the inner contour (6) of the reflecting surface (3) is symmetrical with respect to the x-axis and asymmetrical with respect to the y-axis.

3. A discharge lamp as claimed in claim 2, characterized in that the inner contour (6) of the reflecting surface (3) has the shape of an ellipse or of a rectangle with rounded corners, or is formed by semicircular arcs and straight lines.

4. A discharge lamp as claimed in claim 1, characterized in that the inner contour (6) of the reflecting surface (3) is adapted to the contour of the asymmetrical burner such that the surface area of the reflecting surface (3) reaches a maximum.

* * * * *